US005365995A

United States Patent [19]

Warner

[11] Patent Number: 5,365,995

[45] Date of Patent: Nov. 22, 1994

[54] METHOD OF CURING HOT BOX SAND CORES

[75] Inventor: Thomas E. Warner, Medina, Ohio

[73] Assignee: Ford Motor Company, Dearborn, Mich.

[21] Appl. No.: 172,996

[22] Filed: Dec. 27, 1993

[51] Int. Cl.[5] ..... B22C 7/06; B22C 9/12

[52] U.S. Cl. ..... 164/12; 164/16

[58] Field of Search ..... 164/12, 16, 228, 234

[56] References Cited

U.S. PATENT DOCUMENTS

| | | | |
|---|---|---|---|
| 2,976,589 | 3/1961 | Hackett et al. | 164/12 |
| 3,416,593 | 12/1968 | Hathorn | 164/234 |
| 3,442,320 | 5/1969 | Hathorn | 164/228 X |
| 3,461,948 | 8/1969 | Londal et al. . | |
| 3,556,195 | 1/1971 | Lund . | |
| 3,587,709 | 6/1971 | Miller et al. . | |
| 3,802,484 | 4/1974 | Ovodov et al. . | |
| 4,112,515 | 9/1978 | Sandow . | |
| 4,362,204 | 12/1982 | Moore et al. . | |
| 4,573,522 | 3/1986 | Merrien et al. | 164/12 X |

FOREIGN PATENT DOCUMENTS

| | | | |
|---|---|---|---|
| 0257166 | 3/1988 | European Pat. Off. | 164/228 |
| 60-121039 | 6/1985 | Japan . | |
| 1-127139 | 5/1989 | Japan | 164/12 |
| 864511 | 4/1961 | United Kingdom . | |
| 864512 | 4/1961 | United Kingdom . | |
| 1050807 | 10/1983 | U.S.S.R. | 164/228 |
| 1058705 | 12/1983 | U.S.S.R. | 164/228 |
| 1286342 | 1/1987 | U.S.S.R. . | |
| 1521519 | 11/1989 | U.S.S.R. | 164/228 |
| 1051807 | 1/1990 | U.S.S.R. | 164/228 |

OTHER PUBLICATIONS

The Coldbox-Plus Process-Superior Core Quality at Reduced Binder Lever., Prof. Dr.-Ing. D. Boenisch, Giesserei-Institute, Aachen, West Germany, Giesserei 72, 1985, No. 15, pp. 435-444.

*Primary Examiner*—J. Reed Batten, Jr.

*Attorney, Agent, or Firm*—Joseph W. Malleck; Roger L. May

[57] ABSTRACT

A core box has (i) a thermally conductive cope and drag resiliently sealingly mating at essentially a horizontal parting plane, and (ii) core defining walls enclosing an interior and perforated by sand-filtered ports. A sand, resin and liquid catalyst mixture is blown into the interior to form a sand body. At least the outer skin of the sand body is conductively heated to a first temperature (i.e., 300-400° F.); and essentially simultaneously with the conductive heating, the remainder of the sand body is convectively heated by flowing a heated gas therethrough at a second temperature lower than the first temperature (i.e., 250-290° F.). The heated gas enters the sand body from the drag and exits the sand body by way of the cope.

9 Claims, 3 Drawing Sheets

METHOD OF CURING HOT BOX SAND CORES

BACKGROUND OF THE INVENTION

1. Technical Field

This invention relates to sand core making by hot box techniques, and more particularly to full curing of such cores within the hot box itself before removing the core.

2. Discussion of the Prior Art

There are two basic methods using resin bonded sand in cores, the cores being used in subsequent metal casting operations. First, there is the cold box core making method in which polyurethane resin binders are mixed with the sand and the mixture cured by infusion of catalyst gases into the core box to polymerize the binder.

Secondly, there is a hot box core making method which uses a starting sand mixture comprised of resin binders and a liquid catalyst, the mixture being blown into the interior of the core box and then triggered to polymerize by the use of exteriorly applied heat. Heat is conducted from the outer regions of the sand core to the interior regions and, although the curing action takes place at temperature as low as 120° F., it is necessary to achieve temperatures of 450° to 550° F. to stimulate proper polymerization of the sand core within a short period of time, such as 20 to 40 seconds (depending upon size and shape of core). In spite of the high temperatures employed, hot box sand cores must be removed prematurely from the core box possessing only a fully cured outer skin with partially cured interior core and then fully cured in a separate independent core furnace. In this manner the hot box core making method has been adapted to high volume rapid production. The exterior applied heat is provided by gas burners impinging on the box, often possessing flame temperatures of about 1600° F. Because the heat is so intense, large massive sand cores can only be cured rapidly to a shallower skin depth, ¼ to ½ inch deep, while the rest of the core remains uncured. Hence, a subsequent furnace curing (post curing) is employed to fully cure the cores after removal from the hot boxes.

Heavy sections cure at the core box interface before curing at the center of the core. A post cure oven is required to reheat the core to complete curing. In both stages, heat is transferred from the surface of the core to its center by conduction only. As sand is a good insulator, the process is energy intensive. Hot box cores continue to cure after they are removed from the core box due to exothermic reaction. Formaldehyde, a product of the curing reaction, is given off directly to the manufacturing area. Also, there is a tendency to burn the cores at the surface and thereby cause scrap.

Hot box core making is desirable because of its low cost, potential for high productivity, and the relative quality of the cores in high volume production. To make such technology even more efficient, it would be desirable to quickly carry out complete curing of the sand cores within the hot core box prior to removal of the core, such as by convection heating in addition to conductive heating. Conventional hot box processes present obstacles to providing a solution to this problem: (i) purging gas flows are inefficient in energy usage and are too hot or too cold; (ii) the process must be able to work with large complex cores having large aspect ratios and thereby need support when separating the hot box; (iii) purging gas flow paths are not optimized to increase productivity and reduce polymerization time periods; and (iv) the processes do not adequately and uniformly introduce the proper heat throughout the total interior of the core.

SUMMARY OF THE INVENTION

It is an object of this invention to provide a hot box core making process that overcomes the above problems. Pursuant to this object, the invention is a method of making resin bonded sand cores using heat activated catalysts, comprising (a) providing a core box having (i) a thermally conductive cope and drag resiliently sealingly mating at essentially a horizontal parting plane, and (ii) core defining walls enclosing an interior and perforated by sand-filtered ports; (b) blowing a sand, resin and liquid catalyst mixture into said interior to form a sand body; (c) conductively heating at least the outer skin of said sand body to a first temperature; and (d) essentially simultaneously with said conductive heating, convectively heating the remainder of said sand body by flowing a heated gas therethrough at a second temperature, said heated gas entering said sand body from the drag and exiting said sand body by way of said cope.

The first temperature is essentially 300°–400° F. and the second temperature is essentially 250°–290° F. The gas is heated in two stages, first to 175°–225° and thence to 250°–290° F.

DETAILED DESCRIPTION AND BEST MODE

Figure 1:
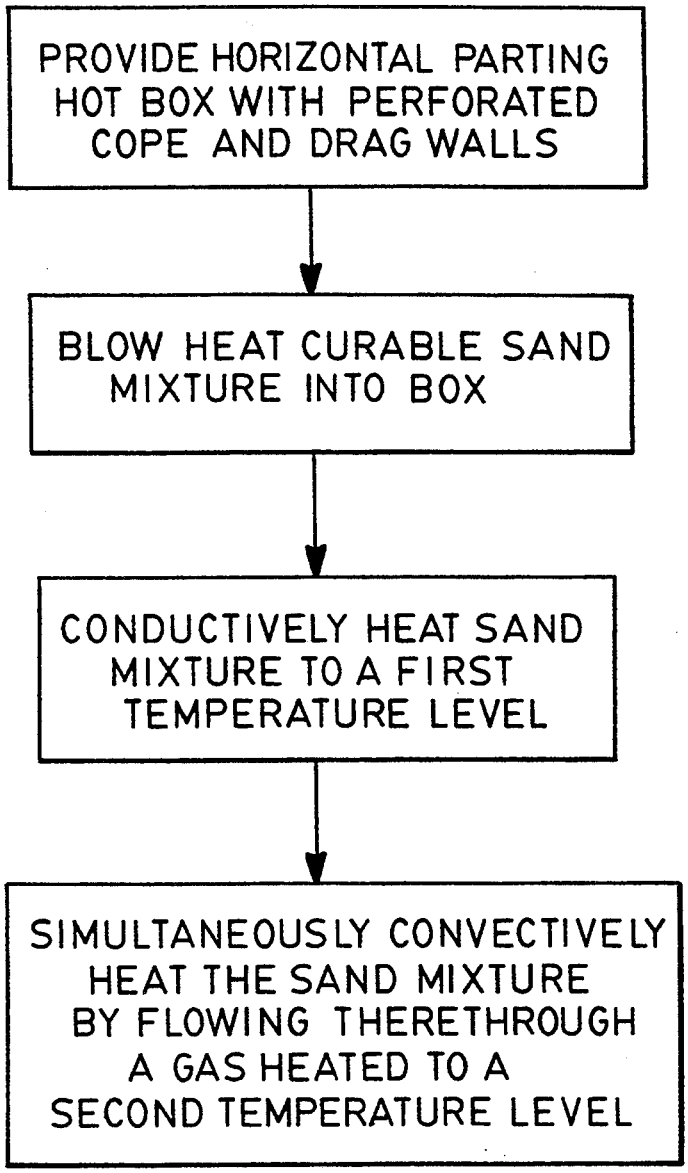
FIG. 1 is a flow diagram of the process for making sand cores employing the hot box apparatus of this invention.
Figure 2:
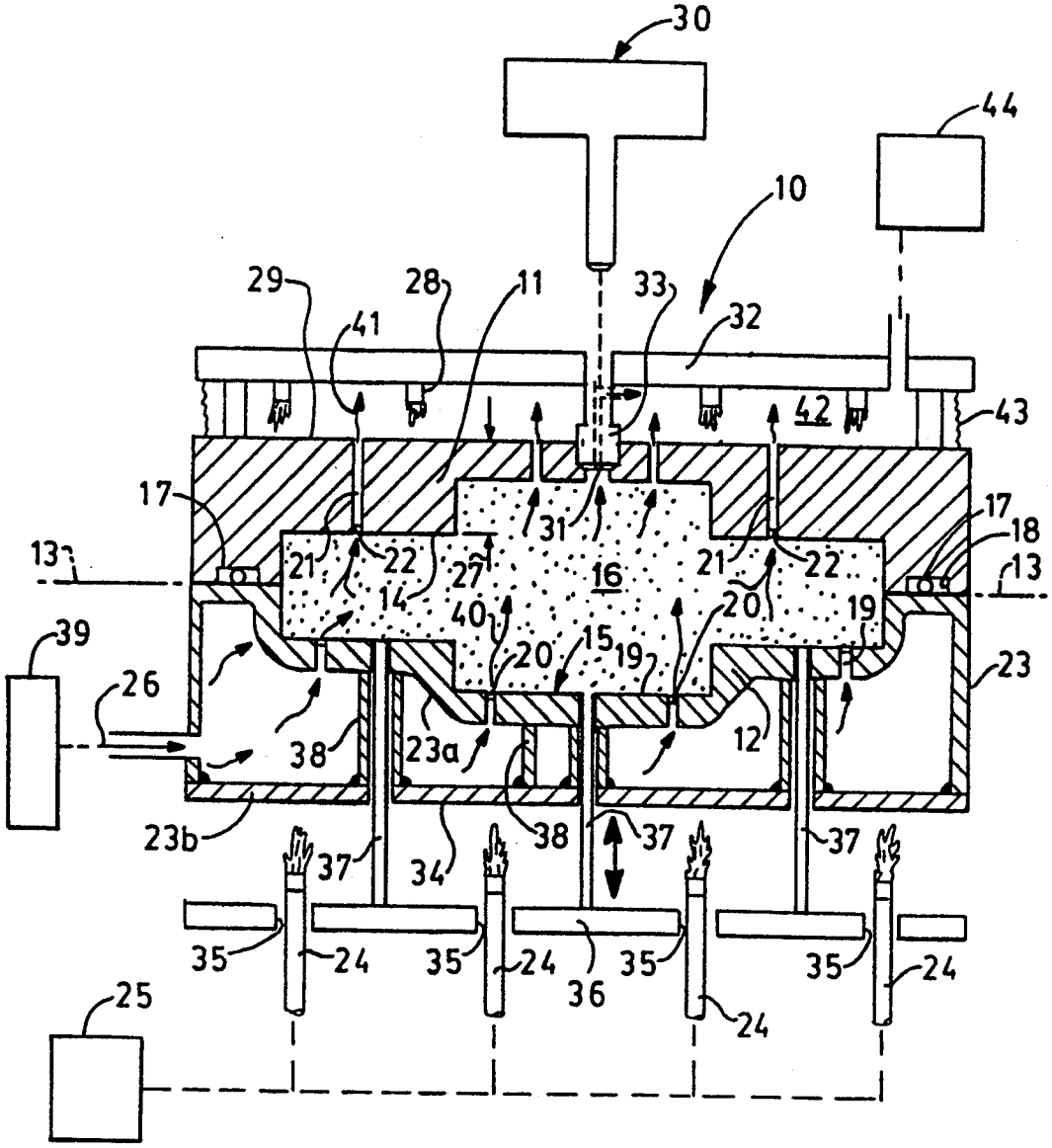
FIG. 2 is a sectional elevational view of a hot box apparatus design embodying the principles of this invention.

As shown in FIG. 1, the first step of the core making process is to provide a horizontal-parting hot box with perforated cope and drag walls. As shown in FIG. 2, the hot box 10 has a cope 11 and drag 12 mating at the plane 13; the cope and drag have core defining walls 14, 15 respectively defining an interior space 16 when mated. A continuous resilient seal 17 is contained in at least one groove 18 extending around the interior 16 to define a sealing means. The interior space defines the shape of the core and, for purposes of this invention, has an aspect ratio greater than one necessitating the need for a horizontal parting plane. The range of sand core sizes enabled by this invention is one to six. The steps of wall 15 of the drag have ports or perforations 19 at predetermined spacings along the lateral extend of the core. Each port 19 has a screen 20, or equivalent sand filtering element, on the interior side of the port (each screen may have a mesh of about 70, depending on the particle size of the sand). Similarly, the cope has stepped walls 14 with ports or perforations 21 at predetermined spacings along the lateral extent of the core body. Each cope port opening 21 has a screen 22 or equivalent sand filtering element on the interior side of the ports.

The drag 12 has an integral manifold 23 interposed between the series of gas burners 24 conductive heating means. The manifold permits the thickness of the drag wall 15 to be much thinner than that for the cope since direct impingement of burner flames has been removed. Such thinness also facilitates quick passage of heat to the gas or heated air 26 through the manifold. The cope wall 14 has a greater thickness 27 to withstand the direct impingement of flames from gas burners 28 impinge on the upper surface 29 of the cope. The greater thickness of the cope wall 14 and the interpositioning of manifold 23 at the bottom of the drag 12 limits the temperature of the core box at the parting plane 13 to about 400° F., thus enabling the seal material to resist such temperature range as well as have resiliency at such high temperatures. Examples of O-ring seal materials useful in such sealing means comprise silicon rubber or graphite compound. These materials have sufficient resiliency to seal under loads ranging from 40,000 to 60,000 lb. force and reseal again at prolonged temperatures of 400°-500° F.

The next basic step of the method is to blow a heat curable sand mixture into the interior 16 of the core box such as by use of a blowing apparatus 30. The method will work with a variety of sands having varying acid demands between 2 and 40 and sands from various origins such as wedron, beneficiated lake and manley sands. Such blowing of sand is through a central conical opening 31 in the cope wall 14; the sand is blown into the space 16 at a pressure of about 90 psi. The sand mixture contains an exothermic resin activated by heat. The resin may be a furan type containing a phenol-formaldehyde base modified with urea or a furfuryl type containing urea-formaldehyde material modified with furfuryl alcohol. The resin is present in an amount of 1.25%-2.0% (based on sand weight). In addition to the resin, the sand mixture will contain a proprietary amount of liquid catalyst, approximately 20% (based on resin weight). Formaldehyde is reduced to levels of 0.1-0.7 ppm. The activator or catalyst in the mixture is a liquid that is temperature activated such as at an initial threshold level of at least about 175° F. The heat producing resin system will eventually form a small amount of water and cured resin as a result of the application of heat thereto. Typical sand mixtures consist of 1.25-2.0% resin binder (based on sand weight) and approximately 20% liquid catalyst (based on binder weight).

When the interior is completely filled with the proper amount of sand mixture, the blowing apparatus 30 is removed and replaced with a stripper plate 32 which supports a blow tube plug 33 effective to seal against the conical surface of opening 31. The stripper plate is moved to insert the plug 33 into the blow hole 31 closing off such hole.

The third step of the process in FIG. 1 is to conductively heat the sand mixture in the core box to a first temperature level such as about 250° F. To this end, the conductive heating means comprises a plurality of gas burners 24 which are spaced and directed to impinge burner flames directly on the lower surface wall 34 of the manifold 23 to create a uniform heating of such wall. Similarly, gas burner units 28 are fixed to the stripper plate 32 and depend therefrom to impinge gas flames on the upper surface 29 of the cope. The gas burners 28 ride up and down with a movement of the stripper plate. The gas burners 24 protrude loosely through access openings 35 in an ejector plate 36 which carries a plurality of ejector pins 37; the pins pass not only through the manifold 23 but through the wall 15 of the drag. The ejector pins are sufficient in number to impart a small removal force to the cured core when raised above wall 15 to remove the core from the core box. To enhance the conduction of heat from the gas burners impinging on the lower surface 34 of the manifold 23, solid conductors 38 may be implanted as rods or fins between the upper side **23*a* and the lower side 23*b*** of the manifold to more readily carry heat therebetween.

The basis for the chemical process is furfuryl alcohol resin, phenolic resin, or a mixture of furan and phenolic-+acid sale catalyst+450 to 555° F.=cured resin+water.

Hot box binders cure uniquely. After the sand has been coated, it is blown into a heated corebox. The "wet mix" begins to cure as soon as it comes into contact with the hot pattern. At temperatures over 120° F., the acid sale catalyst decomposes. A weak acid is formed that causes the resin to polymerize via an exothermic condensation reaction that generates water as it proceeds.

At normal pattern operating temperatures (450 to 550° F.) the core will form a cured, hardened skin starting at the rate of about 1/16 in. per 5 sec.

The hot box cure (dwell) part of the cycle almost always is too brief in prior art processes to cure the core completely. It continues to cure even after removal from the heated pattern. But the hot box cure is sustained and completed by residual heat in sand and by the mildly exothermic chemical reaction.

Once the sand temperature goes above 120° F. and approaches that of the heated pattern, the catalyst decomposes and cures the resin quickly. The cure continues to completion or until the temperature of the sand drops back to below the 120° F. critical cure temperature.

Because the machine cure cycle in the hot box process is short, it is imperative to keep the sand hot, thereby continuing the cure for as long as possible. Many foundries have high-velocity exhaust hoods built over the core belts to carry away fumes and to cool cores so that they can be handled and stored easily. In effect, such rapid cooling shortens the cure cycle. A lower-velocity exhaust system still can carry away the fumes, but will not cool the cores too quickly.

Catalyst selection normally is based on the acid demand value (ADV) and other chemical properties of the sand. An ambient temperature change of 20° F. and/or variations of plus or minus 5 units in the ADV of the sand probably call for some type of a catalyst adjustment. Resin manufactures need only a few basic types of resins, but many different catalysts are used to contend with the temperature, sand chemistry, and other changes that occur.

The weak acid salt catalysts are either granular or water solutions of urea and ammonium chloride or ammonium nitrate in combination with small amounts of modifiers. A granular catalyst offers precise control of the process because the amount of chloride can be adjusted independently of the water and buffers that accompany the active ingredient in the water-borne systems. In addition, the chloride/urea ratio can be tailored by the manufacturer to provide a stronger or weaker catalyst.

Conventional hot box resins are classified simply as furan or phenolic types. The furan types contain furfuryl alcohol, the phenolic types are based on phenol, and the furan-modified phenolic of course has both. All conventional hot box binders contain urea and formaldehyde. The furan hot box resin has a fast "front-end" cure compared to that of the phenolic-type system and therefore can be ejected from the corebox faster. Furan resin also provides superior shakeout and presents fewer disposal problems. Typical resin content is 1.5 to 2.0%.

Conventional hot box resins contain 4 to 10% free formaldehyde and 6 to 13% nitrogen (the catalyst contains 15 to 25% nitrogen). The formaldehyde odor is irritating and is most apparent at the coremaking station. The nitrogen, which is present in a form of ammonia, is known as "ammoniacal nitrogen" because each nitrogen atom is attached chemically to three atoms of hydrogen.

The fourth step of the basic process in FIG. 1 is to simultaneously convectively heat the sand mixture in space 16 by flowing therethrough a gas (such as air) heated to a second temperature level such as 250°-290° F. To this end, convection heating means comprises a remote heating device 39 effective to raise a gas or air supply to a first stage temperature such as 175° F., and to deliver such first stage heated gas to the interior of manifold 23 to allow such heated gas to further absorb heat from the manifold during its temporary residency therein. This causes the gas to be heated to a second level such as 250°-290° F. for introduction into the sand core. The gas flow 40 migrates from the lower portion of the core upwardly therethrough and out through the ports 21 of the cope. The emissions 41 that exit from the ports 21 are trapped and collected within a space 42 enclosed by the stripper plate 32 and bellows or bonnet 43 surrounding the outer edges of the stripper plate and cope. Thus, the emissions are collected and conducted to a fume collection system 44. The bellows or bonnet may be constructed of a flexible ceramic cloth which resists temperatures up to 600° F. maximum. The period of gas flow through the core mixture in the core box varies from 20 to 50 sec.

Figure 3:
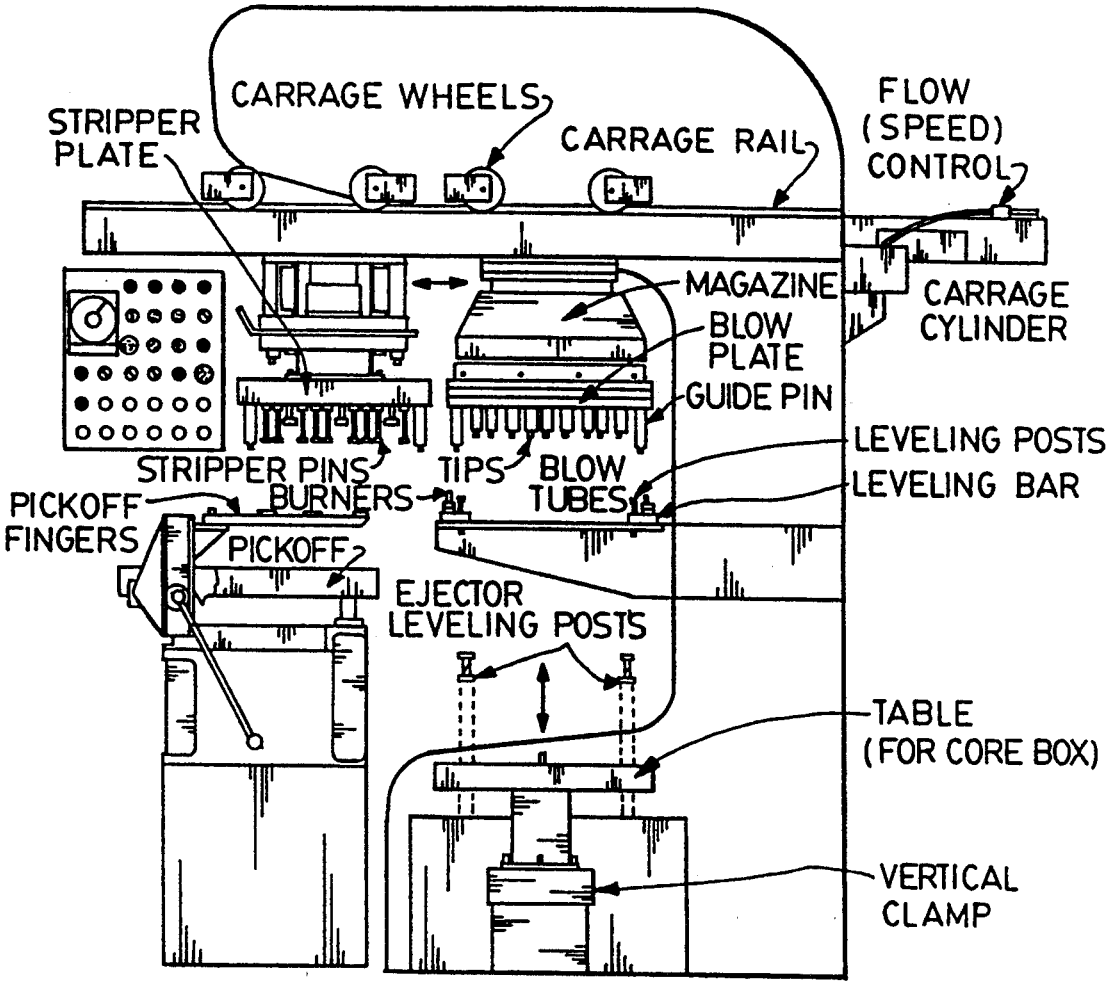
FIG. 3 is a elevational view of a device for using the core box during the core making cycle.

The emissions will generally contain formaldehyde in a concentration range of 0.1 to 0.75 ppm. By trapping such emissions the odor level of the ambient air about the process station is substantially reduced after core box opening and there is no post-baking required. Further use of the apparatus of FIG. 3 is apparent from the disclosure in U.S. Pat. No. 4,158,381.

I claim:

1. A method of making resin bonded sand cores using heat activated catalysts comprising:

(a) providing a core box having (i) a thermally conductive cope and drag resiliently sealingly mating at essentially a horizontal parting plane, and (ii) core defining walls enclosing an interior and perforated by sand-filtered ports;

(b) blowing a sand, resin and liquid catalyst mixture into said interior to form a sand body;

(c) conductively heating at least the outer skin of said sand body to a first temperature; and (d) essentially simultaneously with said conductive heating, convectively heating the remainder of said sand body by flowing a heated gas therethrough at a second temperature lower than said first temperature, said heated gas entering said sand body from the drag and exiting said sand body by way of said cope.

2. The method as in claim 1 in which said first temperature is in the range of 300°-400° F. and said second temperature is in the range of 250°-290° F.

3. The method as in claim 1 in which said resin and catalyst constitute approximately 2.3% of said mixture by weight.

4. The method as in claim 1 in which said heated gas is heated in two stages, first to 175°-225° F. and thence to 250°-290° F.

5. The method as in claim 1 in which said heated gas is pressurized in the range of 5-100 psi, said pressure being selected in proportion to the thickness of the sand body in a ratio of 2 to 3 psi per ¼" of sand.

6. The method as in claim 1 in which said mixture is exposed to said conductive and convective heating for a period of 20 to 50 seconds.

7. The method as in claim 1 in which said drag has a thermally conductive manifold along one side and said conductive heating is carried out by directly heating the manifold and cope.

8. The method as in claim 1 in which said first and second temperatures are adjusted to suit the metal selected for the cope and drag.

9. In a method of processing a sand core by the hot box resin technique, the steps comprising:

(a) while conductively heating a core box, purging air, heated to a temperature of 250°-290° F., through the sand core to polymerize the interior of said sand core; and (b) terminating said conductive heating and purging after a period of 20 to 50 seconds.

* * * * *